US006462731B1

(12) United States Patent
Stoffers et al.

(10) Patent No.: US 6,462,731 B1
(45) Date of Patent: Oct. 8, 2002

(54) JOYSTICK

(75) Inventors: Michael Stoffers, Berlin (DE); Henning Koschke, Berlin (DE); Klaus Lamm, Berlin (DE); Willi Semmelroggen, Berlin (DE); Uwe Gillmann, Berlin (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/378,606

(22) Filed: Aug. 20, 1999

(30) Foreign Application Priority Data

Aug. 21, 1998 (DE) ..... 198 38 004

(51) Int. Cl.[7] ..... G09G 5/08

(52) U.S. Cl. ..... 345/161; 345/156; 463/38; 74/471 XY

(58) Field of Search ..... 345/161, 156; 463/38; 74/471 XY

(56) References Cited

U.S. PATENT DOCUMENTS 4,365,521 A * 12/1982 Kohler ..... 74/471 XY
4,415,782 A * 11/1983 Elmberg ..... 200/6 A
4,500,867 A 2/1985 Ishitobi et al. ..... 338/128
4,639,667 A * 1/1987 Andresen ..... 324/208
5,532,476 A * 7/1996 Mikan ..... 250/221
5,576,704 A * 11/1996 Baker et al. ..... 341/20
5,619,195 A * 4/1997 Allen et al. ..... 200/6 R
5,675,359 A * 10/1997 Anderson ..... 200/6 R
5,911,627 A * 6/1999 Pilot et al. ..... 463/38

FOREIGN PATENT DOCUMENTS

DE 32 36 481 A1 10/1982

* cited by examiner

*Primary Examiner*—Bipin Shalwala
*Assistant Examiner*—Jimmy H. Nguyen
(74) *Attorney, Agent, or Firm*—Roger C. Turner

(57) ABSTRACT

The invention relates to a joystick having a hand-grip, which is mounted with two degrees of freedom in a mounting in a housing and which may be deflected in different directions out of an initial position, the grip being biased by a spring mechanism towards its initial position and sensor apparatus being provided to sense the different positions of the grip and to generate an output signal which may be used to control machine and/or vehicle functions. A housing cover (5) is provided having its upper side directed towards the grip, while on the underside, there is pivotally mounted a cardan joint center portion (6) on whose underside there is pivotally mounted a cardan joint inner portion (7), whose underside is provided with spherical segments, which are mounted in complementary bearing cup-portions provided on a receiving support (8).

7 Claims, 6 Drawing Sheets

JOYSTICK

CROSS-REFERENCE

Applicant claims priority from German patent application 19838004.6 filed Aug. 21, 1998.

The present invention relates to a joystick having a hand-grip, which is mounted with two degrees of freedom in a mounting in a housing and which may be deflected in different directions out of an initial position, the grip being biased by a spring mechanism back towards its initial position and the different positions of the grip being sensed by sensor apparatus which outputs a signal which is used to control machine and/or vehicle functions.

As regards the mounting, use may be made of a ball-and-socket joint or a cardan joint. A cardan joint comprises three joint portions, which are pivotally connected by means of guides. These guides consist of a large number of individual parts. Moreover, the effort required for assembly is great. Ball-and-socket joints have three degrees of freedom. However, in the case of joysticks, rotation about the grip axis is not required. On that account, such rotation is prevented by a pin which is fastened to the socket and engages in a vertical groove in the ball. This arrangement, however, is susceptible to wear and is only capable of bearing light stresses. The problem on which the present invention is based is to provide a joystick which overcomes or mitigates the aforementioned disadvantages. In particular, it is desirable that the joystick should be economic to manufacture and easy to install.

In regard to a joystick having a grip, which is mounted with two degrees of freedom in a mounting in a housing and which may be deflected in different directions out of an initial position, the grip being biased by a spring mechanism back towards its initial position and in which the different positions of the grip are sensed by sensor apparatus which outputs a signal which is used to control machine and/or vehicle functions, it is proposed that on the underside of a housing cover which has its upper side directed towards the grip, there should be pivotally mounted a cardan joint centre portion on whose underside there is pivotally mounted a cardan joint inner portion, whose underside is provided with spherical segments, which are mounted in complementary bearing cup-portions provided on a receiving support. In regard to the device according to the invention, there may be employed a cardan joint in which the bottom half is cut away. Because of this, the joint can easily be assembled by engaging the parts together. The receiving support prevents the elements of the cardan joint from coming apart.

A particular embodiment of the invention is characterised in that on the side of the cardan joint inner portion which is directed away from the grip, there is provided a magnet whose movement is recorded by a sensor carried by a printed-circuit board which is mounted in the housing. By this means it is readily guaranteed that the deflection of the grip will be accurately sensed. In addition, the number of individual parts of the joystick is kept small.

Another particular embodiment of the invention is characterised in that the grip comprises a grip tube having a stop for a spring, which is biased against a plate which engages on the housing cover. The spring ensures that after the grip is deflected, it is restored to its initial position. The joint portions are pulled upwards by the force of the spring.

In regard to the joystick described at the beginning, the position of the joystick is sensed by sensors which provide an output in the form of an electrical signal. This signal is used to control machine and vehicle functions. In most cases, several switches are disposed in the grip of the joystick. The cables for these switches may possibly be led through a corresponding recess in the joint. If the joystick is used in agricultural and construction machines, it must be capable of withstanding high loadings. The mounting of the joystick must therefore be dimensioned correspondingly sturdily. The provision of the recess for the cables which are led through the mounting also leads to the dimensions of the joystick being increased. In conventional joysticks, the sensors are attached outside the mounting. When using Hall sensors, there is fastened to the grip tube a magnet which is disposed in proximity to a sensor which is fastened to the housing. Depending on the position of the grip and of the magnet, the voltage at the sensor varies. The attachment of magnet and sensor outside the mounting leads to a relatively large spacing between magnet and sensor. This has the result that very large magnets must be used in order to guarantee effective functioning of the joystick.

A further problem which the invention seeks to solve is therefore that of reducing the dimensions of the housing of the joystick. In particular, it is desirable that the spacing between magnet and sensor should to be reduced.

In regard to a joystick having a grip, which is mounted with two degrees of freedom in a mounting in a housing and which may be deflected in different directions out of an initial position, the grip being moved by a spring mechanism back into its initial position and the different positions of the grip being sensed by a sensor apparatus which outputs a signal which is used to control machine and/or vehicle functions, it is proposed in a preferred embodiment of the invention, that the sensor apparatus should be arranged inside the mounting. This has the advantage that when using Hall sensors, the spacing between magnet and sensor is reduced. Moreover, the susceptibility to interference as a result of electromagnetic influences from outside the housing of the joystick is reduced.

One particular embodiment of the invention is characterised in that the mounting is provided by a cardan joint having a substantially annular cardan joint centre portion which is mounted in the housing, and a cardan joint inner portion which is mounted by means of a rotary guide in the cardan joint centre portion and is fork-shaped. As a result of the fork-shaped construction of the cardan joint inner portion, space for a sensor apparatus is provided in the cardan joint.

Another particular embodiment of the invention is characterised in that the rotary guide comprises bearing pins which are attached to the cardan joint inner portion and are guided in slide bushes which are fastened in the cardan joint centre portion. The guiding of the bearing pins in the slide bushes guarantees smooth working and virtually wear-free functioning of the joystick.

Another particular embodiment of the invention is characterised in that on the cardan joint inner portion, there is mounted a ring magnet which cooperates with sensors which are attached to a printed-circuit board, which is fastened to the housing, underneath the ring magnet, with the aid of a support. In the event of a deflection of the grip, the ring magnet mounted on the cardan joint inner portion executes a movement corresponding to the deflection of the grip. The movement of the ring magnet is sensed with the aid of the sensors arranged in the vicinity.

Another particular embodiment of the invention is characterised in that the printed-circuit board cooperates with an electronic analysis circuit which is accommodated in the housing. Damage to individual elements of the sensor apparatus on account of improper operation or the effect of dirt is reliably prevented by the arrangement of the complete sensor apparatus inside the housing of the joystick.

Another particular embodiment is characterised in that the grip comprises a grip tube which is formed on the cardan joint inner portion. Because of this, it is achieved that even very great forces may be applied to the grip without damage occurring.

Another particular embodiment of the invention is characterised in that on the grip, there is mounted at least one switch which serves to control machine and/or vehicle functions and is connected by means of at least one cable, which is led through the grip tube, the ring magnet and the support, to the electronic analysis circuit. The guiding of the cable through the ring magnet guarantees reliable functioning of the joystick in every desired configuration.

Another particular embodiment of the invention is characterised in that the deflection region of the joystick comprises a first region, in which the restoring force of the grip increases only comparatively slightly, and a second so-called dwell-pressure region in which the grip, having passed a pressure-point, can move a little further, and in that at least one arcuately shaped leaf spring is fastened to the grip tube with the aid of a mounting. In one known device, a spring-mounted locking ram is fastened to each axis. This locking ram is pressed by a spring against a ramp fastened to the housing. The behaviour of the grip during return to its position can be influenced by the shape of the ramp. The restoring force of the grip changes as a function of the angle of the ramp in relation to the direction of movement of the ram. This conventional solution requires a separation of the axes of movement of the grip. Moreover, it is necessary to provide space for the ramp in the vicinity of the axes of movement. The assembly dimensions of the joystick are increased because of this. These disadvantages are avoided in one particular embodiment of the invention, by means of an arcuately shaped leaf spring which may be attached to the grip tube. Moreover, the invention makes it possible to manage with fewer individual parts than is the case in known devices.

A further particular embodiment of the invention is characterised in that in the mounting, a recess is provided for the purpose of receiving the deformed leaf spring. The movement of the spring may then be limited by the size of the recess. Deformation of the spring in the reverse direction is prevented by this limitation of the movement of the spring.

Another particular embodiment of the invention is characterised in that the deflection region of the joystick comprises a first region, in which the restoring force of the grip increases only comparatively slightly, and a second so-called dwell-pressure region in which the grip, having passed a pressure point, can move a little further, and in that on the grip, there is displaceably mounted at least one spring-biased ram which cooperates with a detent contour provided at the edge of a connecting member, which detent contour limits the deflection of the grip.

The geometric configuration of the detent contour may be chosen so as to determine whether the grip will engage in the end position or will spring back.

Other advantages, features and details of the invention are disclosed in the following description, given with reference to the drawings, in which different embodiments of the invention are shown, by way of example only. In this connection, the features mentioned in the description and in the appended claims may be relevant to the invention either individually or in combination. In the drawings:

DESCRIPTION OF THE PREFERRED EMBODIMENTS

Figure 1:
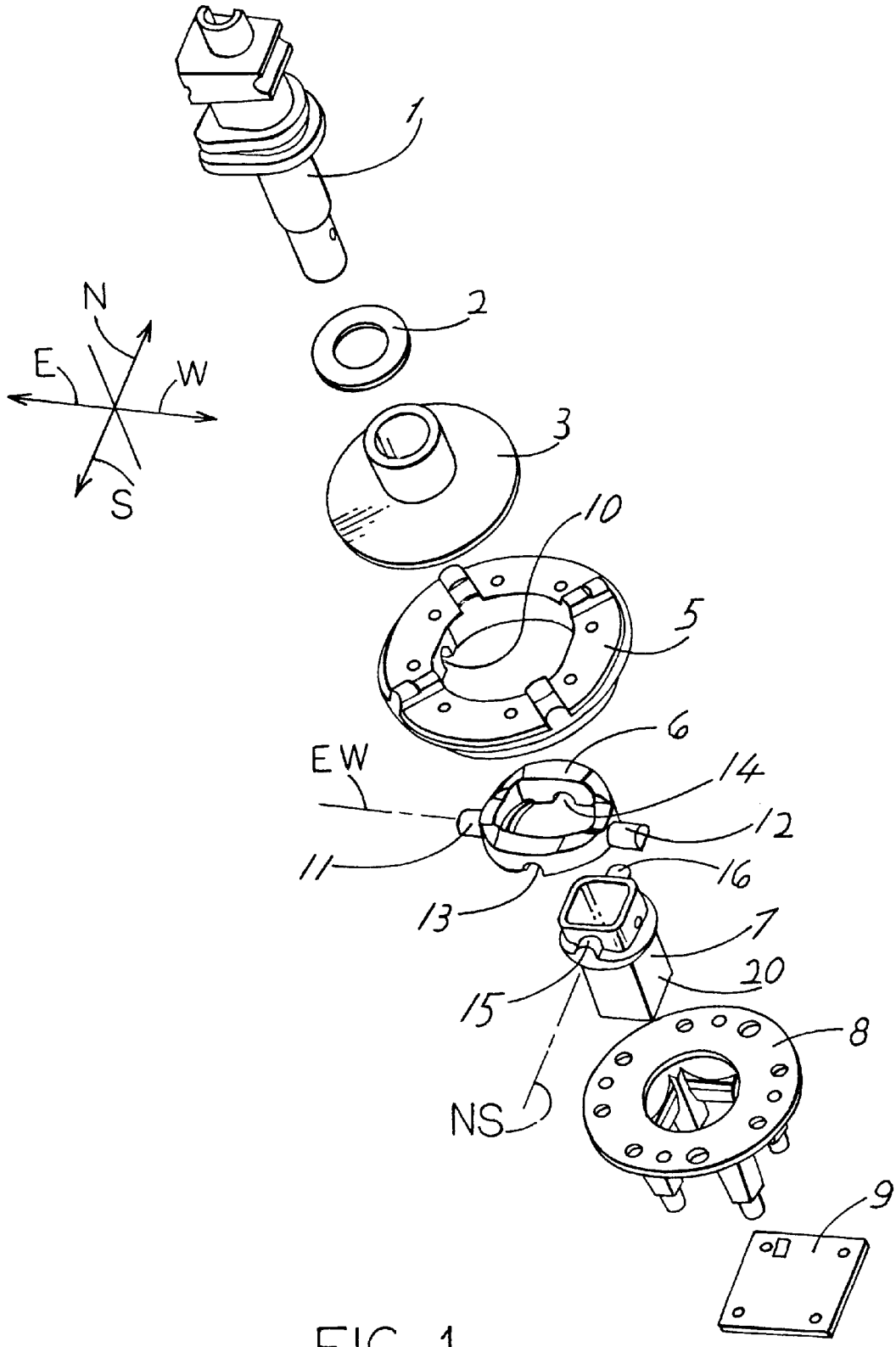
FIG. 1 is an exploded perspective view of a joystick according to a first embodiment of the invention.
Figure 3:
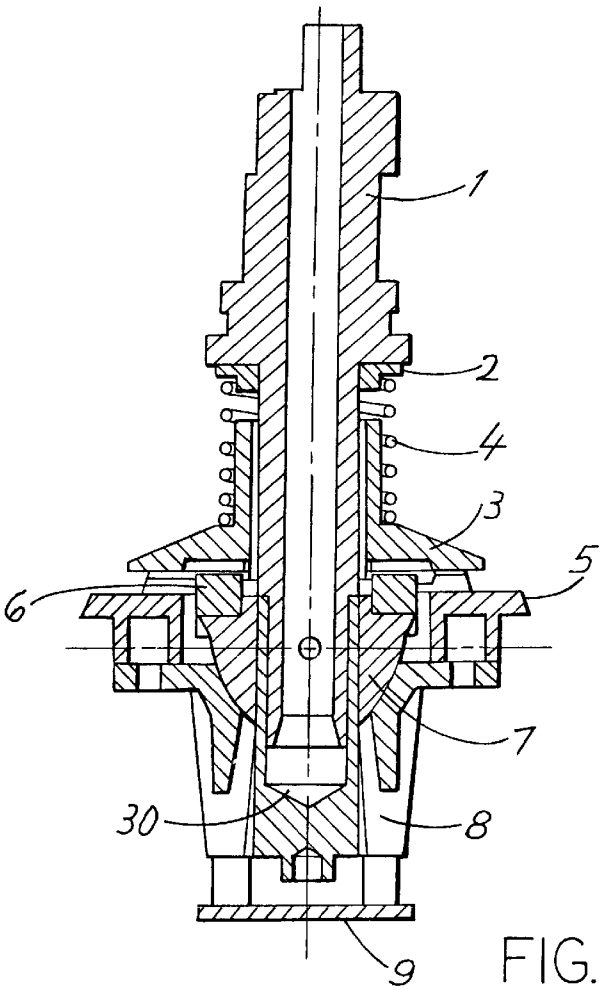
FIG. 3 is a longitudinal sectional view through the joystick shown in FIG. 1, displaced through 90° relative to the representation shown in FIG. 2.
Figure 2:
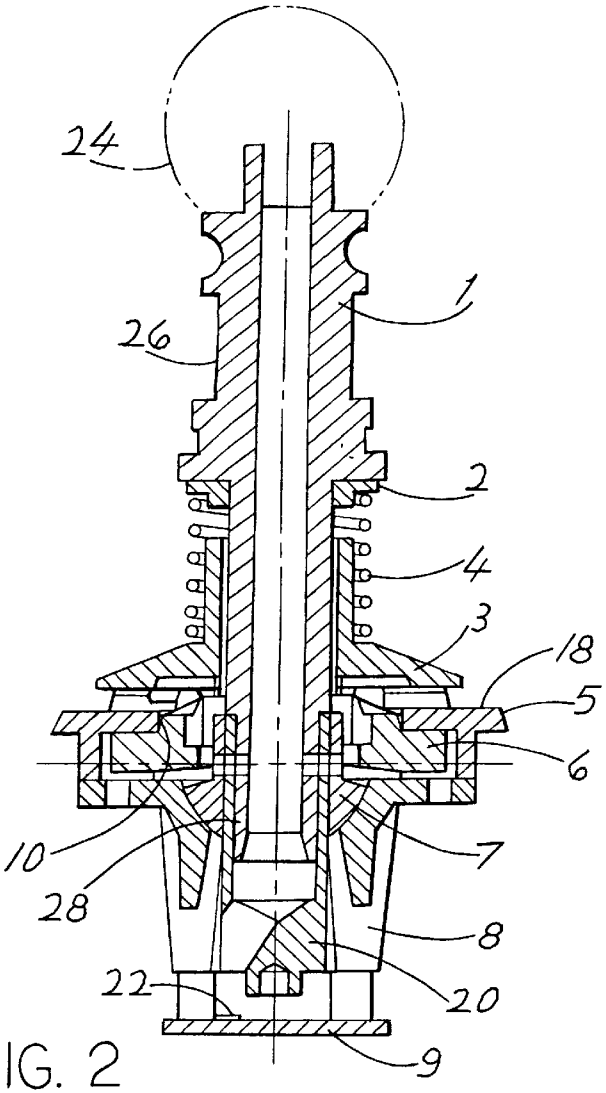
FIG. 2 is a longitudinal sectional view through the joystick shown in FIG. 1.

The joystick shown in FIGS. 1 to 3 comprises a lever in the form of a tube 1, which carries a hand-grip or handle 24 on its upper portion 26. The grip tube 1 serves to receive a ring 2 which, when in position on the grip tube 1, forms a stop for a spring 4. The spring (represented only in FIGS. 2 and 3) is pressed against a plate 3. The plate engages against a cover 5, which forms part of a housing which surrounds the articulated mounting of the grip tube 1. The housing also includes a receiving support 8.

On the underside of the housing cover 5 there are provided two semi-cylindrical shaped recesses, of which one is identified by the reference number 10 in FIG. 1. The semi-cylindrical shaped recesses 10 serve to receive bearing pins 11 and 12, which are formed on the centre portion 6 of cardan joint. By this means it is provided that the cardan joint centre portion 6 may tilt about an axis EW extending in East E and West W directions, which passes longitudinally through the bearing pins 11 and 12. Two semi-cylindrical shaped recesses 13 and 14 are provided on the underside of the cardan joint centre portion 6, offset through 90° in relation to the bearing pins 11 and 12. The semi-cylindrical shaped recesses 13 and 14 serve to receive two bearing pins 15 and 16 which are provided on the inner portion 7 of the cardan joint. The inner position 7 can pivot about an axis NS extending in North N and South S direction.

As is to be seen in FIGS. 2 and 3, the cardan joint inner portion 7 is formed with spherical segments. The spherical segments serve for mounting the cardan joint inner portion 7 in a receiving support 8. For this purpose, bearing cup-portions complementary to the spherical sections of the cardan joint inner portion 7 are constructed in the receiving support 8. The receiving support 8, which is formed with an internal opening extending through it, rests on a printed-circuit board 9. Into the opening of the receiving support 8 there extends a magnet in the shape of a right parallelepiped which is formed on the cardan joint inner portion 7 at the lower end 30 of the lever.

In the assembled state, the grip tube 1 extends through the cardan joint inner portion 7. The cardan joint inner portion 7 is fastened to a lower portion 28 of the grip tube 1 by a pin. Because of this, it is provided that the cardan joint inner portion 7 shall execute the same movements as the grip tube 1. After deflection of the grip tube 1, the spring 4 ensures that the grip tube 1 is restored to its initial position. The spring 4 engages by means of the plate 3 against the housing cover 5. The joint is a cardan joint in which the bottom half is cut away. The recesses serving as bearing points in the cardan shaft centre portion 6 and the cardan shaft inner portion 7 are open to the bottom. Because at this, the joint can easily be assembled by engaging the parts together. The individual joint portions are pulled upwards by the force of the spring 4. This prevents the components of the joint from coming apart. However, it would be possible to press the joint downwards by overcoming the spring force. This is prevented by the receiving support 8, which supports the joint from underneath. Sensing of the position of the grip is achieved by Hall sensors which are arranged on the printed-circuit board 9. These Hall sensors react to the position of the magnet which provided on the inner sensors position 7 of the cardan joint.

Figure 4:
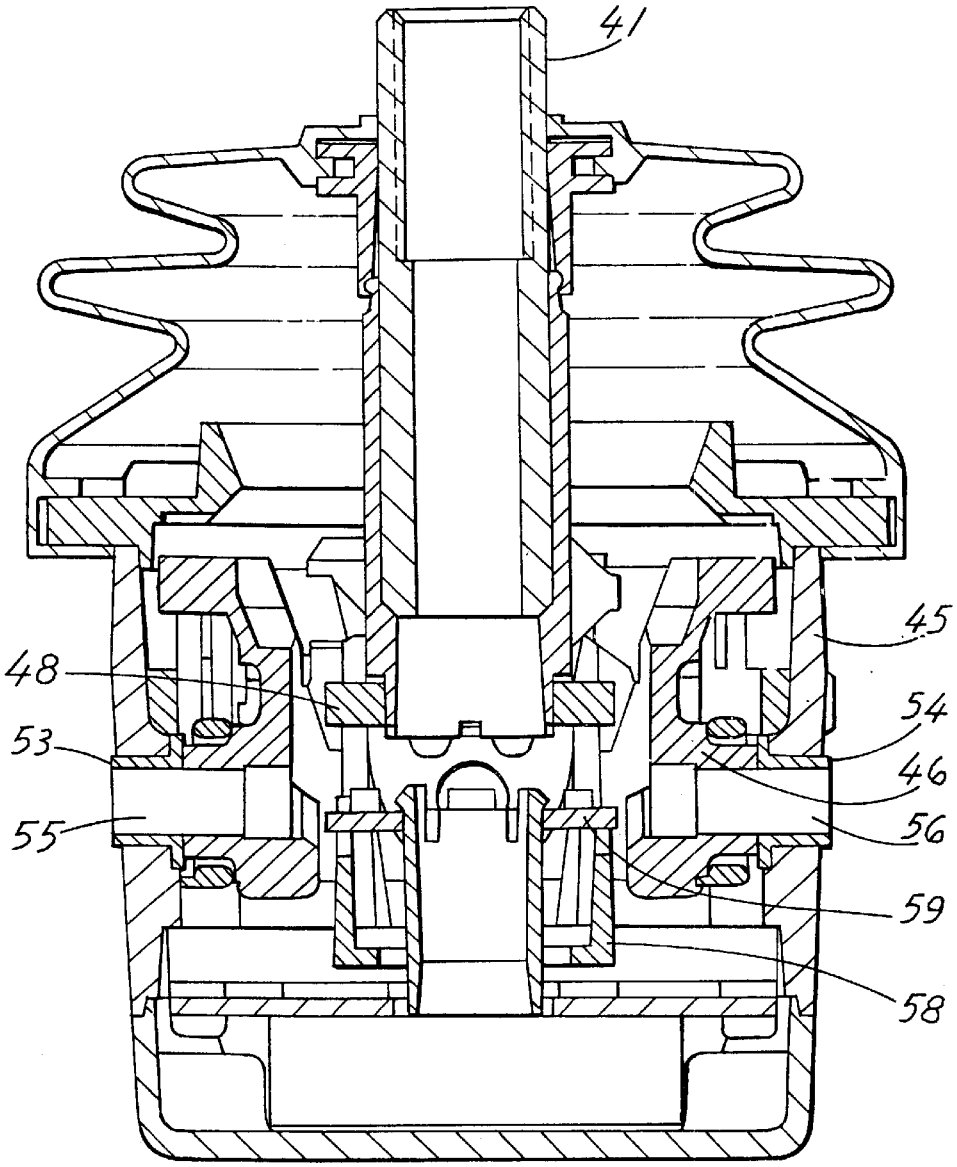
FIGS. 4 and 5 are longitudinal sectional views, offset from one another by 90°, through a joystick according to a second embodiment of the invention.
Figure 5:
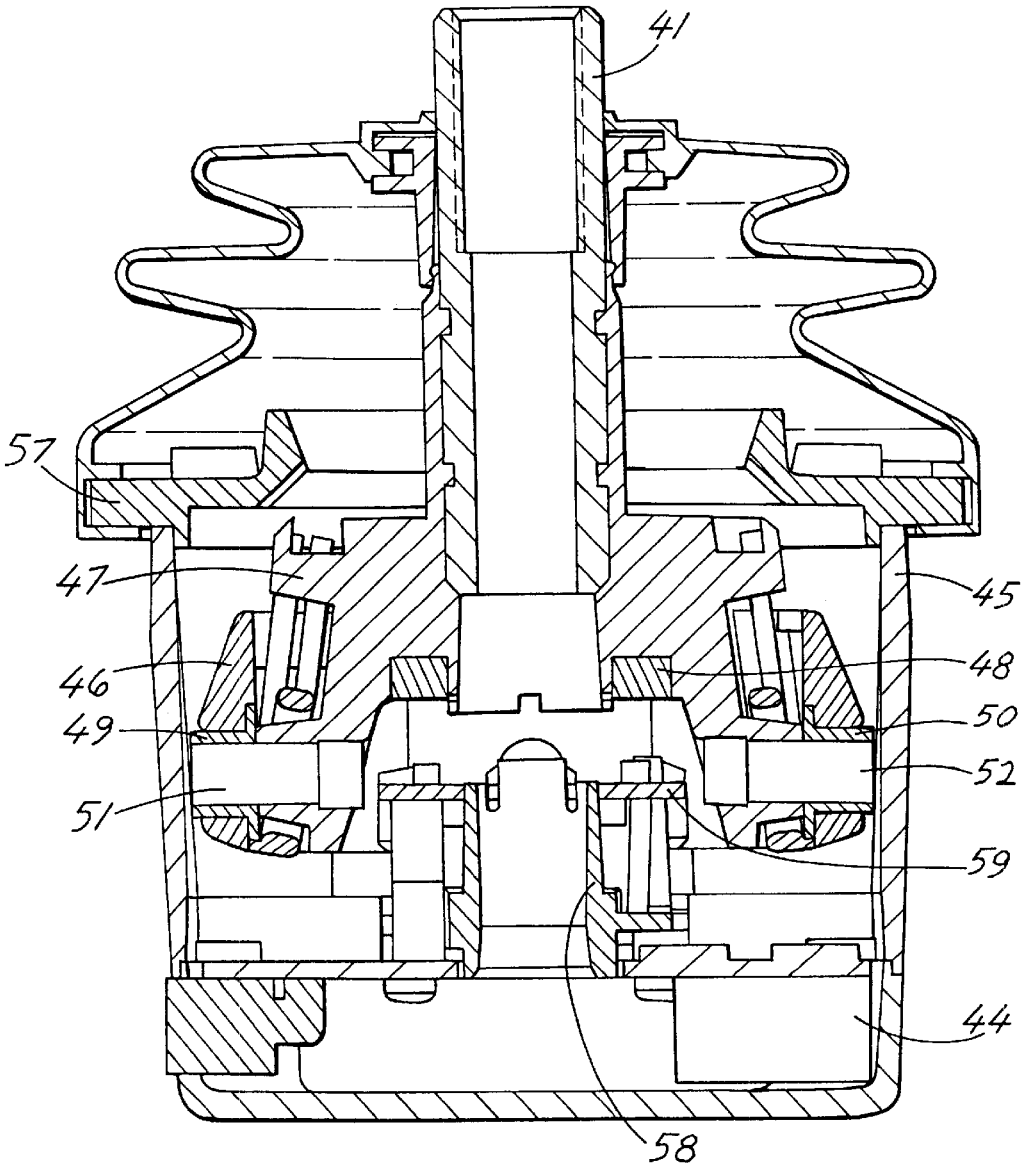

The joystick represented in FIGS. 4 and 5 comprises a grip tube 41 which is a mounted in a cardan joint. The cardan joint comprises an annular centre portion 46 and a forked inner portion 47, which are accommodated in a housing 45. The cardan joint centre portion 46 is pivotally mounted in the housing 45 by means of a rotary guide. The rotatary guide is formed by two bearing pins 55 and 56, which are attached to the cardan joint centre portion and are guided in slide bushes 53 and 54. The bearing pins 55 and 56 as well as the slide bushes 53 and 54 are arranged on an axis which is perpendicular to the longitudinal axis of the grip tube 41.

As is to be seen in FIG. 5, two slide bushes 49 and 50 are arranged in the cardan joint centre portion 46 on an axis which is perpendicular to the longitudinal axis of the grip tube 41 and perpendicular to the axis which passes through the bearing pins 55 and 56. The slide bushes 49 and 50 serve to receive two bearing pins 51 and 52, which are attached to the cardan joint inner portion 47. The cardan joint inner portion 47 is joined rigidly to the grip tube 41. By this means it is guaranteed that the cardan joint inner portion 47 executes the same movements as the grip tube 41 when the latter is deflected.

The cardan joint inner portion 47 is in the form of a fork. A ring magnet 48 is mounted inside the cardan joint inner portion 47, concentrically with the grip tube 41. The ring magnet 48 moves together with the grip tube 41 when the latter is deflected. The movement of the ring magnet 48 is detected by Hall sensors which are arranged on a printed-circuit board 59. The spacing between the ring magnet 48 and the Hall sensors on the printed-circuit board 59 is small, as is to be seen in FIGS. 4 and 5. The printed-circuit board 59 is fastened to the housing 45 by means of a support 58.

Cables which, for the sake of clarity, are not shown in the drawings are led through the grip tube 41, the cardan joint inner portion 47, the ring magnet 48, the cardan joint centre portion 46, the annular printed circuit board 59 and the support 58 to an electronic analysing circuit 44.

The deflection of the grip tube 41 is limited by a connecting link 57 which is mounted on the housing 45.

Figure 6:
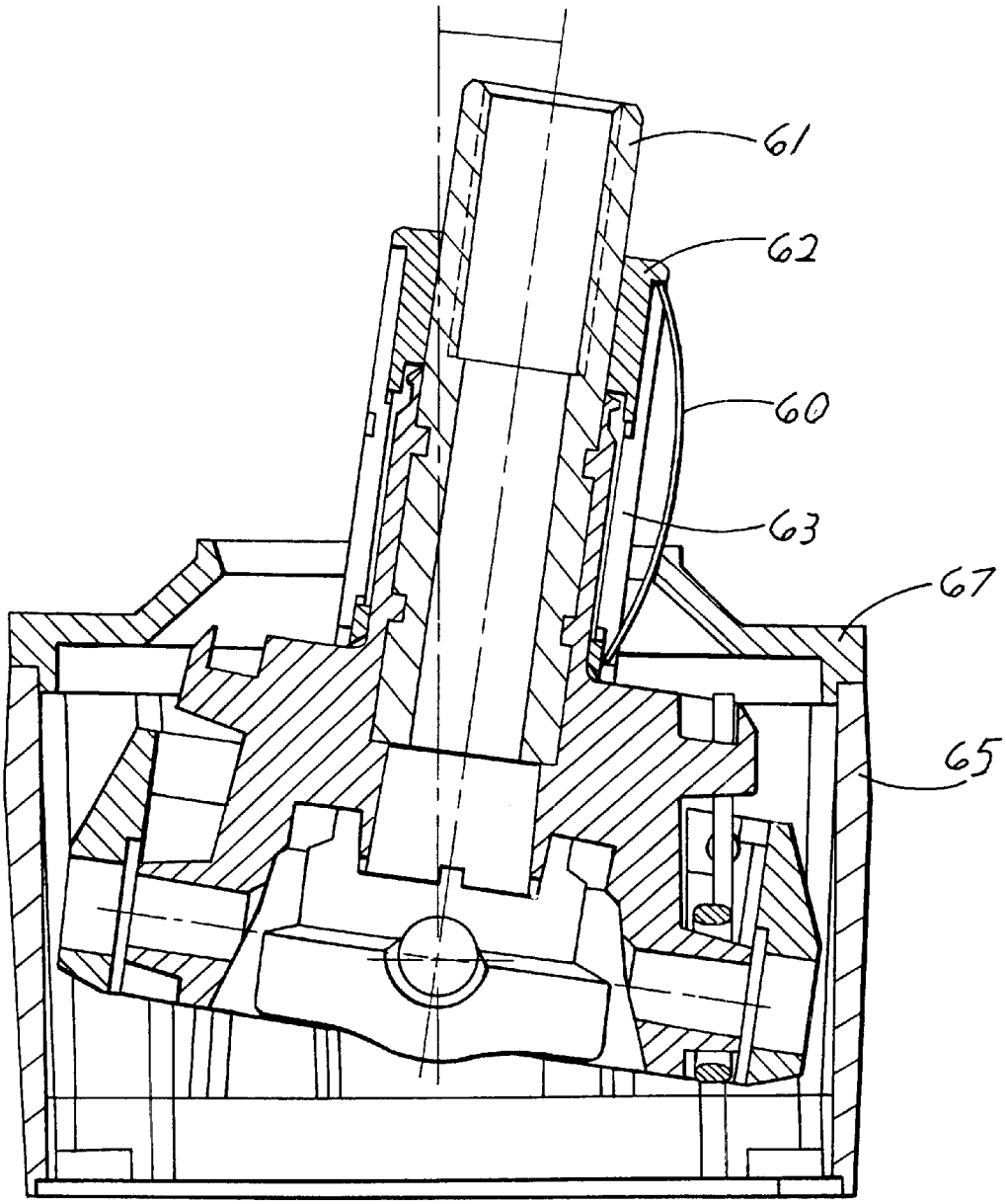
FIG. 6 shows a longitudinal section through a joystick according to a third embodiment of the invention.

In FIG. 6, a joystick is shown which has two different regions of deflection. In the first region, the restoring force of the grip increases only slightly. A stop should be noticeable at the end of this region. In the second region, the grip should move onwards a little, following application of a substantial force. At the end of the second region, a digital signal is generated. The restoring force of the grip should decrease again after a sharp rise.

In the case of the joystick shown in FIG. 6, the pressure function between the two deflection regions is achieved by an arcuately biased leaf spring 60, which is fastened by means of a support 62 to the grip tube 61 of the joystick. On the housing 65 of the joystick there is fastened a connecting member 67 which limits the deflection of the grip tube 61. The leaf spring 60 is arched outwards away from the grip tube 61. At a particular deflection of the grip tube 61, the leaf spring 50 touches the edge of the connecting member 67. Upon further deflection of the grip tube 61, the spring force of the leaf spring 60 must be overcome. The spring force of the leaf spring 60 which acts against a further deflection increases until the leaf spring 60 is deflected in the region of the edge of the connecting link 67, into a recess 63 which is provided on the support 62. The resilient deformation the leaf spring 60 is limited by this means. Without such limitation of its deformation the leaf spring 60 might be deformed so far that the deformation at its lower end would become greater than the deformation at its upper end. In such a case, the deformation of the leaf spring 60 would be reversed. It could not then spring back of its own accord out of the reversed position.

Figure 7:
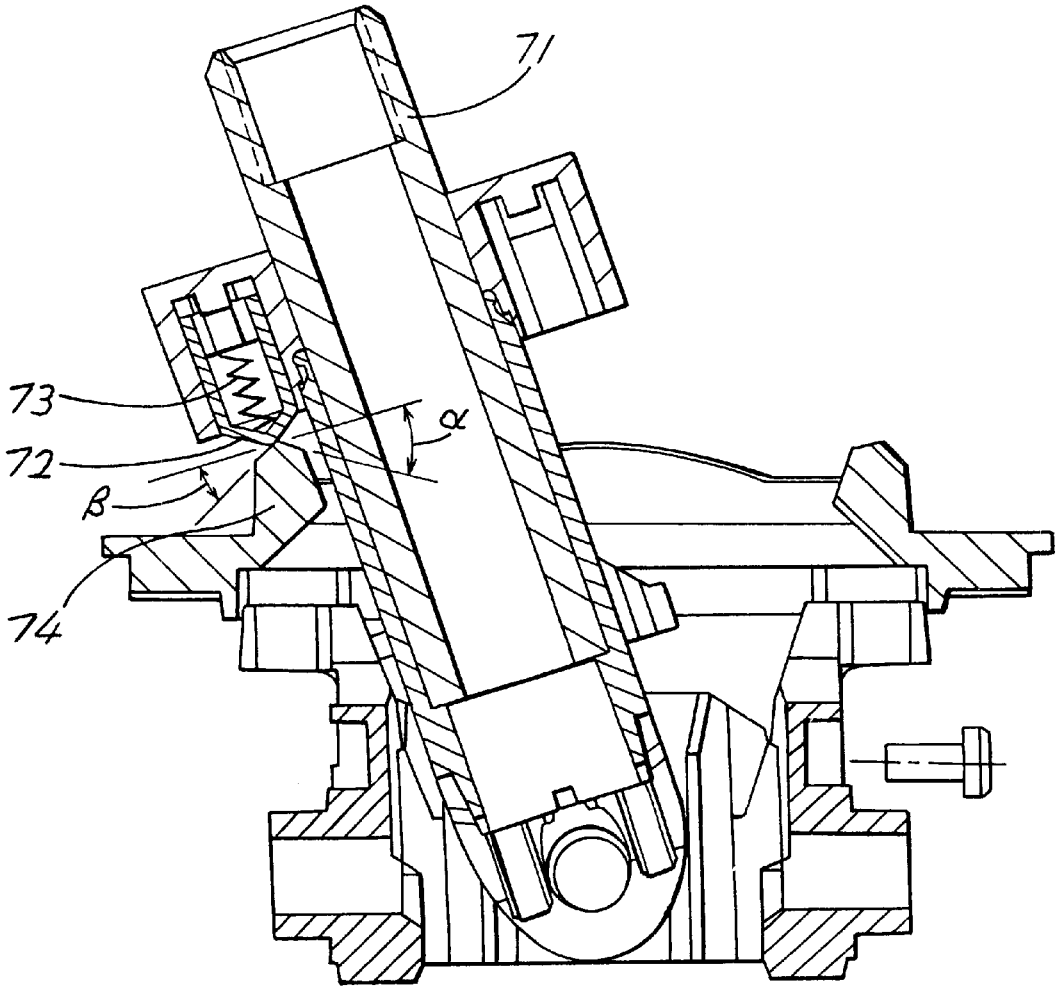
FIG. 7 shows a longitudinal section through a joystick according to a fourth embodiment of the invention.

In regard to the joystick shown in FIG. 7, a ram 72 for each direction of deflection is mounted displacpably on the grip tube 71. The ram 72 is biased by a spring 73. The travel of the ram 72 is limited by stops. The tip of the ram 72 cooperates with the edge of a connecting member 74. The edge of the connecting member 74 has a particular contour, which may be identified by the angles $\alpha$ and $\beta$. The ram is spring-deflected as a function of the angle $\alpha$, by which means the deflecting force of the grip tube 71 is increased. When the ram 72 is moved over the edge of the detent contour of the connecting member 74, the force falls off again. The magnitude of the angle $\beta$ determines whether the grip tube 71 will engage in the end position or will spring back.

What is claimed is:

1. A joystick having a hand-grip which is mounted with two degrees of freedom in a mounting in a housing and which may be deflected in different directions out of an initial position, the hand-grip being biased by a spring mechanism towards its initial position and sensor apparatus being provided to sense the different positions of the hand-grip and to generate an output which may be used to control machine and/or vehicle functions, characterized in that there is a housing cover (5) having its upper side directed towards the hand-grip, while on the underside there is pivotally mounted a cardan joint centre portion (6) on whose underside there is pivotally mounted a cardan joint inner portion (7), the underside of which is provided with spherical segments which are mounted in complementary bearing cup-portions provided on a receiving support (8).

2. A joystick according to claim 1, characterized in that on the side of the cardan joint inner portion (7) which is directly away from the hand-grip, there is provided a magnet, a sensor being provided on a printed circuit board (9) which is mounted in the housing, to sense movement of the magnet.

3. A joystick according to claim 1, characterized in that the hand-grip comprises a grip tube (1) having a stop for a spring (4), which is biased against a plate (3) which engages on the housing cover (5).

4. A joystick that includes a primarily vertically-extending lever having an upper end forming a handle and having a lower portion, comprising:

a housing having a lower surface forming a pair of downwardly-opening first bearing recesses spaced along an East-West axis;

a first joint part with a pair of first pins pivotally engaged with said first recesses to enable said first joint part to pivot about said East-West axis;

said first joint part having a pair of downwardly-opening second recesses spaced along a North-South axis that is perpendicular to and passes substantially through said East-West axis at a common axis point; and a second joint part with a pair of second pins pivotally engaged with said second recesses to enable said second joint part to pivot about said North-South axis;

said second joint part being fixed to said lever lower portion;

a spherical bearing having a convex first spherical part and a concave second spherical part with spherical centers lying approximately on said common axis point, with one of said spherical parts mounted on said housing and the other spherical part mounted on said second joint part.

5. The joystick described in claim 4 wherein:

said housing has an upper surface and forms a hole, with said lever extending primarily vertically through said hole and having a downwardly-facing shoulder;

a plate member lying on top said housing and being capable of rocking on said housing, said plate member having a hole that surrounds said lever; and a helical spring that has an upper end that presses upward toward said shoulder and that has a lower end that presses downward toward said plate member.

6. The joystick described in claim 4 including:

a circuit board fixed to said housing;

a magnet fixed to said handle lever; and a magnetic field sensor mounted on said circuit board adjacent to said magnet.

7. A joystick having a primary vertically-extending lever with an upper portion forming a handle and with a lower portion, comprising:

a housing having a lever-passing hole, said lever lower portion extending down through and below said hole and having a lever lower end;

a bearing assembly that supports said lever lower portion in pivoting about two perpendicular axes;

a circuit board fixed to said housing and lying under said lever lower end;

a magnet fixed to said lever lower end; and

Hall sensor means mounted on said circuit board beneath said magnet;

said bearing assembly includes a cardan joint with inner and outer cardan joint parts, said outer joint part pivotally connected about a first axis to said housing, said inner joint part pivotally connected to said outer joint part about a second axis that is perpendicular to said first axis, and said lever lower portion being fixed to said inner joint part; and said bearing assembly also includes a spherical bearing portion with spherical convex and spherical concave bearing parts that are engaged with one another, with one of said spherical bearing parts connected to said lever lower portion and the other fixed to said housing.

* * * * *